US006182600B1

(12) United States Patent
Brown et al.

(10) Patent No.: US 6,182,600 B1
(45) Date of Patent: Feb. 6, 2001

(54) TRAFFIC CHANNELING DEVICE

(75) Inventors: Gregory H. Brown, Stow; David E. Cowan, Orange Village; David A. Cowan, Pepper Pike, all of OH (US)

(73) Assignee: Plastic Safety Systems, Inc., Cleveland, OH (US)

( * ) Notice: Under 35 U.S.C. 154(b), the term of this patent shall be extended for 0 days.

(21) Appl. No.: 09/187,261

(22) Filed: Nov. 6, 1998

(51) Int. Cl.[7] ..... E01F 9/012; E01F 9/018
(52) U.S. Cl. ..... 116/63 C; 116/63 P
(58) Field of Search ..... 116/63 C, 63 P, 116/63 R; 404/6, 9–14; 40/612; D10/109, 111–114

(56) References Cited

U.S. PATENT DOCUMENTS

| | | | | |
|---|---|---|---|---|
| D. 310,642 | | 9/1990 | Kulp | D10/109 |
| D. 338,631 | | 8/1993 | Braverman | D10/113 |
| D. 406,543 | * | 3/1999 | Brown et al. | D10/113 |
| 3,380,428 | | 4/1968 | Abrams | 116/63 P |
| 3,913,518 | * | 10/1975 | Kaplan | 116/63 C |
| 3,952,690 | * | 4/1976 | Rizzo et al. | 116/63 P |
| 4,925,334 | | 5/1990 | Beard | 404/9 |
| 5,036,791 | | 8/1991 | Thurston | 116/63 C |
| 5,234,280 | | 8/1993 | Cowan | 404/6 |
| 5,421,668 | * | 6/1995 | Cowan et al. | 404/6 |
| 5,451,118 | * | 9/1995 | Wilkins et al. | 404/6 |
| 5,560,732 | | 10/1996 | Kulp et al. | 404/10 |
| 5,630,675 | * | 5/1997 | Boeger | 116/63 C |
| 5,749,673 | * | 5/1998 | Kulp et al. | 116/63 C |
| 5,755,528 | * | 5/1998 | Kulp et al. | 116/63 P |
| 5,868,520 | * | 2/1999 | Kulp et al. | 404/6 |
| 6,014,941 | * | 1/2000 | Bent et al. | 116/63 P |
| 6,019,542 | * | 2/2000 | Bent et al. | 116/63 P |

OTHER PUBLICATIONS

Brochure entitled Top Stackable Channelizer Cone, prior to Apr. 15, 1998.
Brochure entitled New Grabber Vertical Panel Barricade, 1996.

* cited by examiner

*Primary Examiner*—Diego Gutierrez
*Assistant Examiner*—Stanley J. Pruchnic, Jr.
(74) *Attorney, Agent, or Firm*—Renner, Otto, Boisselle & Sklar, LLP

(57) ABSTRACT

Traffic channeling device includes a delineator stem having hollow upper and lower portions, the upper portion being stepped inwardly along its axial length to form sequential stepped surfaces from the bottom to the top of the upper portion, and the lower portion being frustoconically shaped. Adjacent the bottom of the delineator stem is a radial flange portion which resists pullout of one or more ring-shaped base members placed over the top of the delineator stem to act as ballast for the delineator stem. The base members include a non-circular raised portion and a correspondingly sized recessed portion such that when one base member is stacked on top of another, the recessed portion of one base member will receive the raised portion of the other base member and resist relative rotatable movement between the base members.

17 Claims, 2 Drawing Sheets

TRAFFIC CHANNELING DEVICE

FIELD OF THE INVENTION

This invention relates generally to traffic channeling devices used, for example, for guiding and directing normal vehicle traffic around road and highway construction sites and the like, for lane closures, as barricades for work zones and for crowd control.

BACKGROUND OF THE INVENTION

Many different types of traffic channeling devices have been utilized previously. One type that has been widely used comprises a hollow plastic delineator stem that is conically shaped to facilitate stacking of the stems. Also some type of ballast is usually placed near the bottom of the stems to prevent the stems from being inadvertently blown over or moved about by the wind and/or air blasts produced by passing vehicles. One common form of ballast consists of one or more ring-shaped base members which may be placed over the stem and onto an outwardly extending flange of the stem.

One problem with such conically-shaped delineator stems is that they may unnecessarily cause damage to a vehicle when impacted thereby especially if the delineator stems are heavily ballasted. Also, the delineator stems themselves may tear or crack prematurely when impacted by a vehicle, thereby reducing the useful life of the delineator stems.

Another problem with such conically shaped delineator stems is that before reflective sheeting material can be applied to the stems, the sheeting material must be die cut so that it conforms to the conical surface. This is not only wasteful of the reflective sheeting material, which is relatively expensive, it also increases the time and expense of applying the reflective sheeting material to the conical surface. The appearance of the stem may also be affected, for example, by leaving uncovered some portions on the delineator stem because of an insufficient size or cut of reflective sheeting material or by inadvertently applying the material in an uneven manner.

Moreover, ring-shaped ballasts used for anchoring the delineator stems do not make efficient use of space. For example, the ballasts cannot easily be placed into tight work zones or small storage sites.

SUMMARY OF THE INVENTION

The present invention relates to a traffic channeling device that includes a delineator stem and one or more removable external base members that are used as ballast to hold the delineator stem in place during use.

In accordance with one aspect of the invention, the delineator stem includes hollow upper and lower portions wherein the upper portion is stepped inwardly along its axial length to form sequential stepped surfaces from the bottom to the top of the upper portion and the lower portion is frustoconically shaped to provide a substantially larger, outer diameter at the bottom than at the top of the lower portion.

In accordance with another aspect of the invention, the stepped surfaces are substantially vertical and are oriented parallel with respect to the axial length of the upper portion thus permitting bands of reflective sheeting material to be easily applied to the stepped surfaces.

In accordance with still another aspect of the invention, the stepped and frustoconical surfaces of one delineator stem correspond to and are sized to receive respective stepped and frustoconical surfaces of another delineator stem when the delineator stems are stacked one on top of the other.

In accordance with still another aspect of the invention, the upper stem portion includes rounded shoulders disposed between adjacent stepped surfaces. Advantageously, the rounded shoulders stiffen the upper stem portion to thereby resist shearing between adjacent stepped surfaces when the upper portion of the delineator stem is impacted by a vehicle. Moreover, the top of the lower stem portion substantially coincides with a transition shoulder at the bottom of the upper stem portion to provide a generally smooth transition between the upper and lower stem portions.

In accordance with still another aspect of the invention, the upper stem portion includes a handle with a closed loop opening disposed on top of, and preferably integrally molded with, the upper stem portion to facilitate grasping the delineator stem by a person's hand and moving it from one location to another. Advantageously, the stems are sufficiently lightweight that, if desired, up to five stems may be grasped and moved by one person at one time. The handle may also include a mounting hole for attachment of safety devices thereto, and indents on opposite sides of the handle for tying of caution tape to the handle. The uppermost stepped surface of the delineator stem is desirably adapted to receive the handle of another delineator stem when the stems are stacked one on top of another.

In accordance with still another aspect of the invention, the delineator stem includes a radially outwardly extending multi-faceted flange portion adjacent a bottom edge of the lower stem portion for resisting pullout of the delineator stem from the base member. Advantageously, the upper stem portion upon impact by a vehicle is made to substantially withstand the impact without deforming the upper stem portion while the lower stem portion deforms sufficiently to permit the flange portion to pull through the opening in the base member, to cause the delineator stem to become dislodged from the base member leaving the base member behind.

In accordance with still another aspect of the invention, the base member includes a top surface having a non-circular nesting ridge and a bottom surface having a correspondingly sized recessed portion adapted to receive the nesting ridge when one base member is stacked on top of another base member. Advantageously, the base members are maintained in the same orientation when stacked together, permitting the stacked base members to fit into tight work zones or small storage places.

In accordance with still another aspect of the invention, the base member includes at least one slot sized to permit the fingers of a person's hand to fit at least partially therethrough to facilitate grasping the base member and moving it from one location to another.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
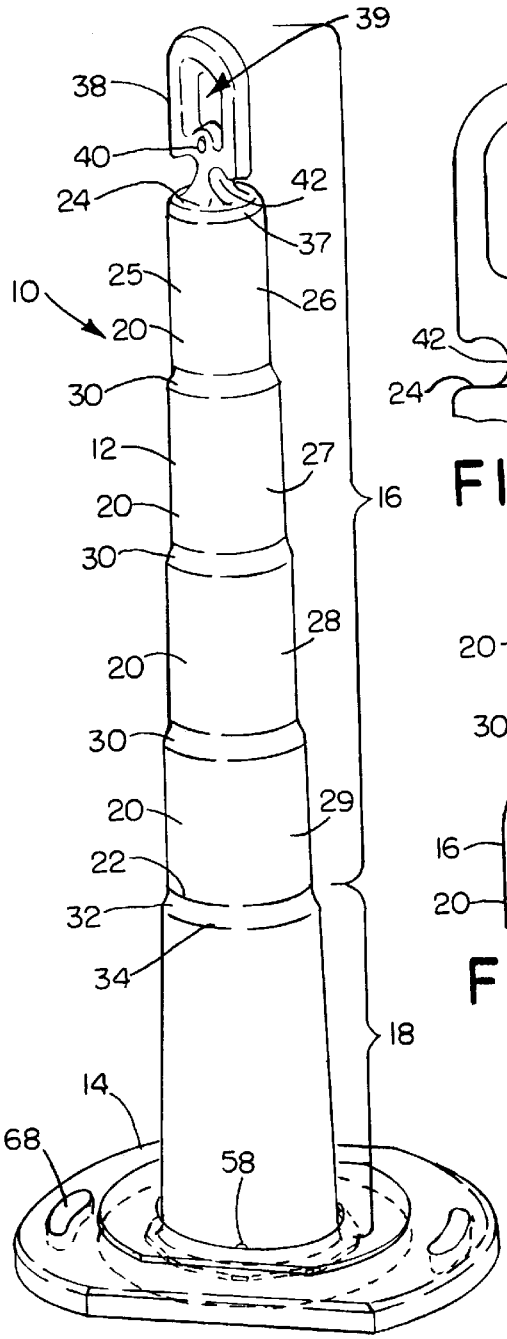
FIG. 1 is a perspective view of a preferred form of traffic channeling device constructed in accordance with the present invention including a delineator stem having a base member inserted over the stem.

Referring now in detail to the drawings, and initially to FIG. 1, one form of traffic channeling device in accordance with this invention is generally indicated by the reference numeral 10 and includes a relatively thin walled, hollow delineator stem 12 and one or more base members 14 inserted over the delineator stem 12 to act as ballast for the delineator stem 12. The delineator stem 12 is desirably blow molded as one piece out of a relatively lightweight resiliently deformable plastic material such as low density polyethylene and includes a generally cylindrical upper portion 16 and a frustoconical lower portion 18 immediately below the upper portion 16. The upper portion 16 is preferably stepped radially inwardly at discrete intervals along its axial length to form sequentially stepped surfaces 20 from the bottom 22 to the top 24 of the upper portion 16.

Figure 3:
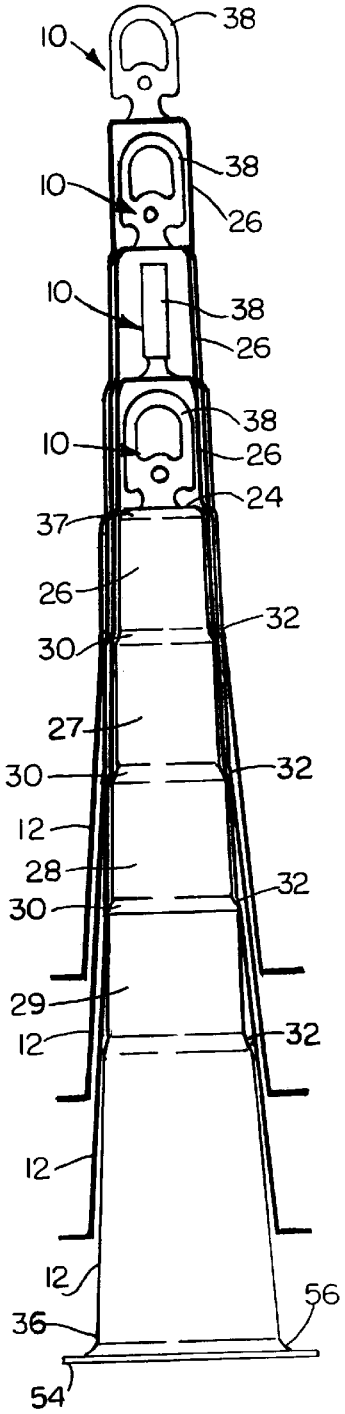
FIG. 3 is a schematic elevation view showing four such delineator stems stacked one on top of another.

As clearly shown in FIG. 3, the plurality of stepped surfaces 20 of the upper portion 12 and frustoconical shape of the lower portion 18 of the delineator stems 12 facilitate stacking of the delineator stems for ease of transporting the stems to and from a job site and storage. Another advantage in making the stepped surfaces 20 cylindrical is that it reduces the amount of reflective sheeting material 25 required to cover the stepped surfaces 20 and eliminates the need of die cutting the sheeting material before applying it to the vertical stepped surfaces.

The stepped surfaces 20 may be of other cross-sectional shapes besides cylindrical, for example multi-sided or oval shaped. Moreover, the number and height of each stepped surface 20 may vary according to the overall height of the upper portion 16 of the delineator stem and the number and width of reflective sheeting bands 25 to be applied to the delineator stem 12. For example, where the overall height of the upper and lower portions 16 and 18 of the delineator stem is 42 inches, the delineator stem desirably has a total of four stepped surfaces 26–29 each having a height, for example, of 6½ inches for the application of up to four bands of reflective sheeting, whereas where the overall height of the upper and lower portions is 28 inches, the delineator stem desirably has a total of two stepped surfaces each having a height, for example, of 6½ inches for the application of up to two bands of reflective sheeting thereto. Also, each stepped surface 20 desirably has an outer diameter that is approximately ½ inch less than the preceding stepped surface from bottom 22 to top 24, with the lowermost stepped surface 29 having an outer diameter, for example, of between approximately 5¼ inches and 5¾ inches and the uppermost stepped surface 26 having an outer diameter, for example, of between approximately 3¾ inches and 4¼ inches.

Figure 4:
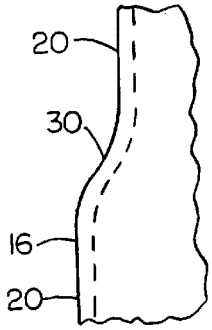
FIG. 4 is an enlarged fragmentary elevation view of the upper stem portion of FIG. 1 which includes rounded shoulders between adjacent stepped portions of the delineator stem.

Disposed between and blended into adjacent stepped surfaces 20 of the upper portion 16 are rounded shoulders 30 (see FIG. 4) which give added strength and rigidity to the upper portion 16 and resist shearing between adjacent stepped surfaces 20 when the delineator stem 12 is impacted by a vehicle. In contrast, the larger diameter, non-stepped frustoconical surface of the lower portion 18 gives the lower portion more flexibility than the upper portion 16 to allow the lower portion to collapse sufficiently to break away from the base members 14 when the delineator stem 12 is hit by a vehicle as described hereafter.

The rounded shoulders 30 between the adjacent stepped surfaces 20 of the upper portion 16 also make it easier to maintain a uniform wall thickness at the shoulders 30 during blow molding of the delineator stems 12.

A rounded transition shoulder 32 at the bottom 22 of the upper portion 16 coincides with the smaller diameter at the top 34 of the lower portion 18 to provide a smooth transition between the upper portion 16 and the lower portion 18 as shown in FIG. 1. In the preferred embodiment disclosed herein, the outer diameter of the lower portion 18 at its bottom end 36 is approximately 7¾ inches whereas the outer diameter of the lower portion at its top end 34 is approximately 6 inches. Also, the axial length of the lower portion 18 is preferably between approximately 15 and 16 inches, which is somewhat less than the typical bumper height of most automobiles. This has the advantage that when a vehicle impacts the delineator stem 12, it will likely impact the upper portion 16 which is better able to withstand the impact without deforming while permitting the lower portion 18 to collapse sufficiently to break away from the base member 14.

Figure 5:
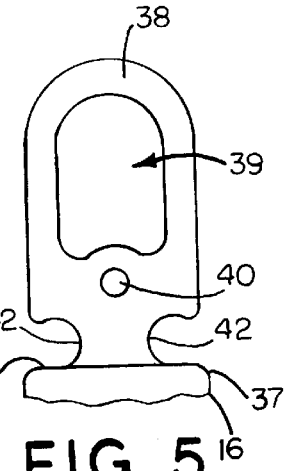
FIG. 5 is an enlarged fragmentary elevation view of the handle portion of the delineator stem.

Referring further to FIG. 1 and also to FIGS. 3 and 5, integrally molded to the top 24 of the upper portion 16 and protruding axially outwardly therefrom is a closed loop handle 38 to facilitate grasping of the delineator stem 12 by hand and moving it from one location to another. The delineator stem 12 is sufficiently light in weight and the opening 39 in the handle 38 is sized such that, if desired, up to five stems 12 may be grasped by a single worker and moved at one time. As shown in FIG. 3, the handle 38 of one delineator stem 12 substantially fits within the uppermost stepped surface 26 of an other delineator stem stacked on top of the one stem without contacting the inside wall of the uppermost stepped surface 26 of the other stem. To that end, in the example given where the stepped surfaces 20 each have a height of approximately 6½ inches and the uppermost stepped surface 26 has an outer diameter of between approximately 3¾ inches and 4¼ inches, the handle 38 has an overall height as measured from the top 24 of the stem of approximately 6 inches and a maximum width of approximately 3 9/16 inches. The extent to which the stems can be stacked one on top of each other is limited by circumferential contact of the transition shoulder 32 at the bottom 22 of the upper portion 16 of the other delineator stem with the transition shoulder 30 between the lowermost two stepped surfaces 28 and 29 of the one delineator stem and the other three transition shoulders 30 of the other delineator stem with the upper two transition shoulders 30 and outer rounded shoulder 37 of the top 24 of the one delineator stem to provide a clearance space between the frustoconical lower surfaces 18 and stepped upper surfaces 20 of adjacent stacked stems as schematically shown in FIG. 3. This reduces the friction between the stacked delineator stems thus preventing them from sticking together for ease of unstacking.

Immediately below the hand grip opening 39 is a suitable mounting hole 40 for attachment thereto of standard warning devices, for example, a flashing light. A pair of indents 42 may be located on opposite sides of the handle 38 for wrapping of caution tape around the handle 38 or for tying of the caution tape off to the handle 38 as desired.

Figure 6:
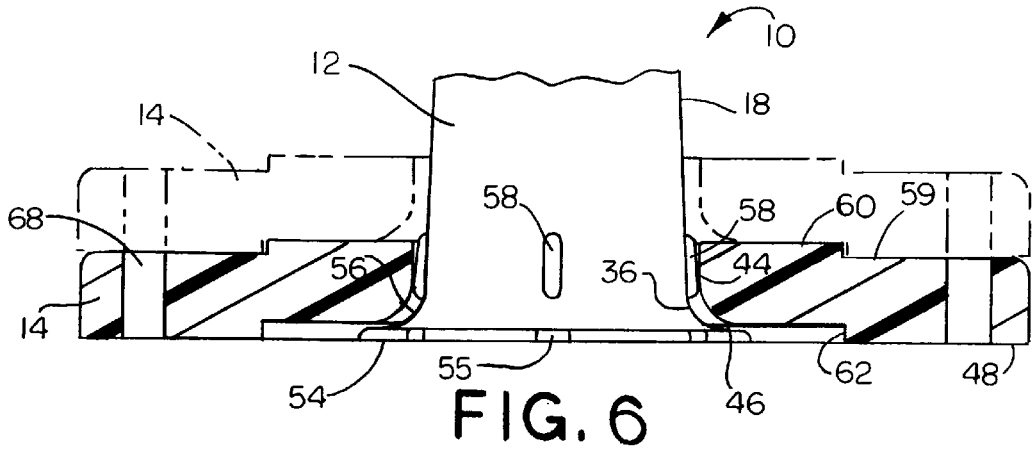
FIG. 6 is an enlarged fragmentary elevation view of the lower portion of the delineator stem and a cross-sectional view of one or more base members inserted over the delineator stem.
Figure 7:
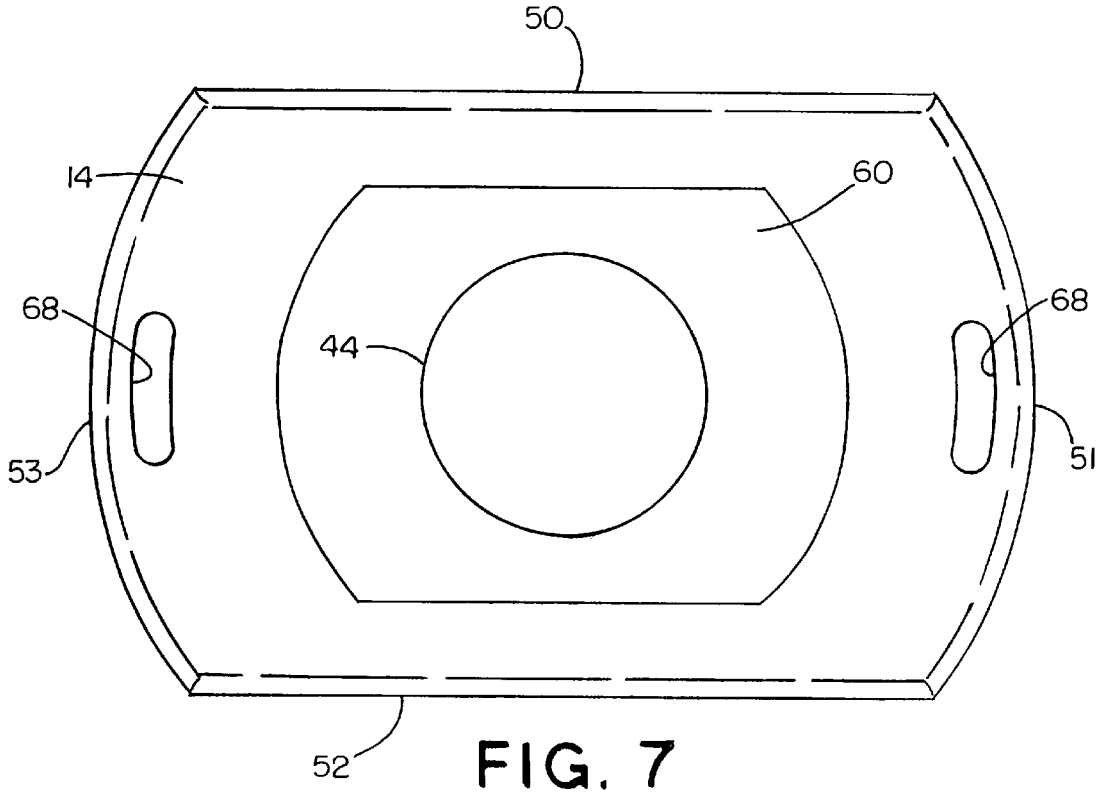
FIG. 7 is a top plan view of one of the base members of FIG. 6.
Figure 8:
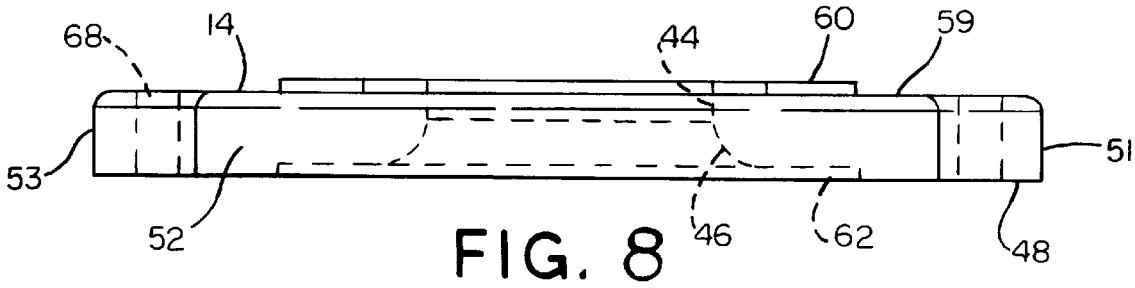
FIG. 8 is a side elevation view of the base member shown in FIG. 7.

The delineator stem 12 is designed to receive one or more external base members 14 to prevent the delineator stem 12 from being blown over or inadvertently moved about by the wind and/or by air currents produced by passing vehicles. As best seen in FIGS. 6 through 8, each base member 14 includes a central opening 44 through which the delineator stem 12 extends. The opening 44 is desirably flared outwardly at 46 towards the bottom surface 48 of the base member 14 to facilitate sliding of the base member 14 down over the top of the delineator stem 12.

The base members 14 are desirably molded out of rubber and may be of different sizes and shapes which may vary in weight, for example, from 10 to 35 lbs. However, for relatively tight work areas, the base members 14 must be as narrow as possible and still provide the desired weight. In this regard, the base member is shown in FIG. 7 as having an oblong, or generally rectangular shape so that it does not require as much clearance space in one direction as it does in another. Accordingly, the length of the base member 14 is substantially greater than the width. In addition, the sides 50, 52 are preferably straight whereas the ends 51, 53 are preferably rounded as shown.

By way of example, the base member 14 may be approximately 2⅜ inches thick, 16 inches wide and 26 inches long with a 13 inch radius on the rounded ends 51, 53 of the base member 14. The opening 44 through the base member 14 may have a diameter of approximately 7⅝ inches, leaving approximately a ⅛ inch diametrical clearance between the base member 14 and the 7¾ inch outer diameter of the bottom end 36 of the lower portion 18 of the delineator stem 12 when inserted thereover as schematically shown in FIGS. 1 and 6.

Figure 2:
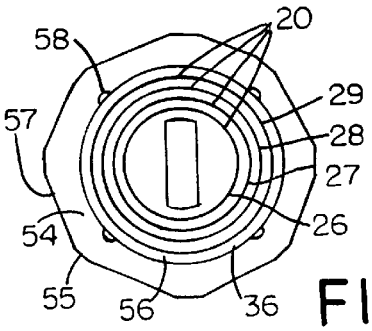
FIG. 2 is a top plan view of the delineator stem of FIG. 1 without the base member.

At the bottom edge 36 of the lower portion 18 of the delineator stem 12 is an integrally molded outwardly extending flange 54 that resists pullout of the delineator stem 12 from the base member 14. In the preferred embodiment disclosed herein, the flange 54 protrudes outwardly from the bottom edge 36 a maximum distance of approximately 1⅜ inches at the corners 55 and has an overall height of approximately 3/16 inch. A radius 56 (see FIGS. 3 and 6) of approximately ¾ inch blends in the bottom 36 of the lower portion 18 with the flange 54. As shown in FIG. 2, the flange 54 has multiple sides 57 which will minimize rolling of the delineator stem 12 when dislodged from the base member 14 upon impact.

A plurality of circumferentially spaced ribs 58 (see FIGS. 2 and 6) are desirably integrally formed on the exterior surface of the lower portion 18 near its bottom 36 to ensure that the base member 14 has a relatively snug fit around the bottom of the delineator stem. In the embodiment disclosed herein, four such ribs 58 are provided equally spaced around the periphery of the lower portion 18, each desirably having a height or length of approximately 1.5 inches, a width of approximately 9/16 inch and a thickness of approximately ⅛ inch.

The relatively large diameter of the lower portion 18 which does not have any type of reinforcement throughout its length except for the relatively short ribs 58 at the bottom allows the delineator stem 12 to collapse sufficiently to permit the bottom flange 54 to pull through the opening 44 in the base member 14 when the delineator stem 12 is hit by a vehicle, leaving the base member 14, which constitutes most of the weight of the traffic channeling device 10, in place. Such a breakaway connection between the base member 14 and the delineator stem 12 also permits the delineator stem 12 to be pulled from the base member 14 by hand for fast and easy take-down when desired.

Under most traffic and weather conditions, a single ten pound base member 14 may be all the ballast that is needed to hold each delineator stem 12 in place. The modular nature of the base members 14, however, enables two or more of such base members 14 to be placed over a single delineator stem 12, one on top of the other as schematically shown in FIG. 6 to add additional ballast as needed.

Referring further to FIG. 6 and also to FIGS. 7 and 8, on the top surface 59 of the base member 14 is a non-cylindrical shaped nesting ridge 60 surrounding the opening 44. A recessed portion 62 of a correspondingly but somewhat larger size and shape is located in the bottom 48 of the base member 14 for receipt of the nesting ridge 60 when one or more base members 14 are stacked one on top of the other as schematically shown in FIG. 6. When nested together, all of the base members 14 are in the same orientation so that the side walls 50, 52 and end walls 51, 53 of all of the base members 14 align respectively with each other.

An advantage of nesting the base members 14 is that the cooperation between the nesting ridges 60 and recessed portions 62 resists relative rotatable movement between stacked base members 14. This is useful, for example, when two or more base members are used to ballast a single delineator stem 12 since it avoids the inconvenience of the base members 14 falling out of orientation and no longer being able to fit into a relatively tight clearance. Also, this further conserves on the amount of space taken up by the base members during storage and when transported to and from a job site.

It will be appreciated that the nesting ridge 60 and the correspondingly sized recessed portion 62 may comprise any suitable shape and/or size and may be located anywhere on the respective top 59 and bottom surface 48 of the base member 14.

Adjacent both ends 51, 53 of the base member 14 and outwardly spaced from the nesting ridge 60 are a pair of slots 68 providing hand grips to facilitate picking up the base member 14.

From the foregoing, it will be apparent that the delineator stems 12 of the present invention may readily be stacked one on top of the other with or without the base members 14 in place over the delineator stems 12 for ease of storage and shipment. Moreover, the traffic channeling devices 10 may easily be set up by dropping the base members 14 over the delineator stems 12 while still on a truck so they are ready to install at the job site.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A traffic channeling device comprising a delineator stem including hollow upper and lower portions, the upper portion being stepped inwardly along its axial length to form sequential stepped surfaces from bottom to top of the upper portion, and the lower portion being frustoconically shaped to provide a substantially larger outer diameter adjacent a bottom end of the lower portion than at a top end of the lower portion, the lower portion having a bottom flange at the bottom end to resist pull out of the delineator stem from a ring-shaped base member when inserted over the delineator stem to act as a ballast for the delineator stem, the lower portion being sufficiently flexible that upon impact of the upper portion by a vehicle, the lower portion will collapse sufficiently to permit the bottom flange to pull through the base member to disengage the delineator stem from the base member, the stepped surfaces on the upper portion providing added rigidity and strength to the upper portion, making the upper portion better able to withstand the impact of a vehicle without deforming.

2. The traffic channeling device of claim 1, wherein the outer wall of the lower portion is uninterrupted from the top end of the lower portion to adjacent the bottom end of the lower portion.

3. The traffic channeling device of claim 2, wherein the lower portion has an axial length of between approximately 15 inches and 16 inches.

4. The traffic channeling device of claim 3, wherein the upper portion has an axial length of between approximately 12 inches and 26 inches.

5. The traffic channeling device of claim 3, wherein the bottom end of the lower portion adjacent the bottom flange has an outer diameter of approximately 7¾ inches and the upper end of the lower portion has an outer diameter of approximately 6 inches.

6. The traffic channeling device of claim 1, wherein the stepped surfaces of the upper portion are substantially vertical and are oriented parallel with respect to the axial length of the delineator stem, thus permitting bands of reflective sheeting to be easily applied to one or more of the stepped surfaces.

7. The traffic channeling device of claim 6, wherein the upper portion further includes rounded shoulders disposed between adjacent stepped surfaces for stiffening the upper portion and for resisting shearing between adjacent stepped surfaces when the upper portion is impacted by a vehicle.

8. The traffic channeling device of claim 1, wherein the top end of the lower portion and the bottom of the upper portion are connected by a transition shoulder therebetween to provide a generally smooth transition between the upper and lower portions.

9. The traffic channeling device of claim 1, wherein the upper portion further includes a handle having a closed loop opening, the handle being disposed on top of the upper portion to facilitate grasping of the delineator stem by a person's hand and moving the delineator stem from one location to another, the uppermost stepped surface of the delineator stem being sized to receive the handle of another delineator stem when two or more delineator stems are stacked one on top of the other.

10. The traffic channeling device of claim 9, wherein the handle further includes a mounting hole disposed below the closed loop opening for attachment thereto of safety devices.

11. A traffic channeling device comprising a delineator stem including hollow upper and lower portions, the upper portion being stepped inwardly along its axial length to form sequential stepped surfaces from bottom to top of the upper portion, and the lower portion being frustoconically shaped to provide a substantially larger outer diameter adjacent a bottom end of the lower portion than at a top end of the lower portion, a base member having an opening permitting the base member to be inserted over the delineator stem to act as ballast for the delineator stem, the delineator stem having a bottom flange at the bottom end to resist pullout of the delineator stem from the base member, the lower portion of the delineator stem being sufficiently flexible that upon impact of the upper portion by a vehicle, the lower portion will collapse sufficiently to permit the bottom flange to pull through the base member to disengage the delineator stem from the base member, the stepped surfaces on the upper portion providing added rigidity and strength to the upper portion, making the upper portion better able to withstand the impact of a vehicle without deforming.

12. The traffic channeling device of claim 11, wherein the base member is oblong shaped, being substantially longer in length than in width.

13. The traffic channeling device of claim 12, where in said base member includes a top surface and a bottom surface, the top surface having a non-circular nesting ridge, and the bottom surface having a recessed portion substantially corresponding in size and shape to the nesting ridge for receipt of the nesting ridge when two base members are stacked one on top of the other in the same orientation to resist rotatable movement of one base member relative to another base member.

14. The traffic channeling device of claim 11, further comprising a plurality of circumferentially spaced ribs protruding axially from the lower portion of the delineator stem adjacent the bottom end of the lower portion to provide a relatively snug fit of the base member around the bottom end of the lower portion.

15. A base member for ballasting a delineator stem of a traffic channeling device, the base member including an opening extending through the base member adapted to receive a delineator stem, the base member including a top surface having a noncircular raised portion, and a bottom surface having a correspondingly sized recessed portion shaped to receive the raised portion and to substantially resist relative rotatable movement between one bas e member and another base member when one base member is stacked on top of another base member.

16. The base member of claim 15, which is oblong shaped, being substantially longer in length than in width.

17. The base member of claim 15, further comprising at least one slot extending completely through the base member outwardly of the raised and recessed portions sized to receive fingers of a person's hand for grasping and moving the base member from one location to another.

* * * * *